United States Patent [19]

Young

[11] Patent Number: 4,878,264

[45] Date of Patent: Nov. 7, 1989

[54] CLEANING EQUIPMENT

[75] Inventor: Ronald A. Young, London, Great Britain

[73] Assignee: Scot Young Service Systems Limited, United Kingdom

[21] Appl. No.: 255,040

[22] Filed: Oct. 7, 1988

[30] Foreign Application Priority Data

Oct. 9, 1987 [GB] United Kingdom ..... 8723799

[51] Int. Cl.[4] ..... A47L 13/50

[52] U.S. Cl. ..... 15/264

[58] Field of Search ..... 15/260–264; 206/204; 210/297, 307

[56] References Cited

U.S. PATENT DOCUMENTS 3,751,746 8/1973 Elbreder ..... 15/260

4,161,799 7/1979 Sorrells ..... 15/264 X

*Primary Examiner*—Edward L. Roberts

*Attorney, Agent, or Firm*—Collard, Roe & Galgano

[57] ABSTRACT

Cleaning equipment comprises a container, such as a bucket usable for mopping, from which cleaning liquid is taken and to which that liquid is returned after it has been used for dirt removal. The container is provided with a dirt trap comprising a dirt-receiving element of mat or pad-like form which is positioned in the container to receive dirt settling under gravity from the contained liquid. The dirt which settles out collects in, or alternatively passes through so as to be trapped below, the element or mat. The form and structure of the element is such that disturbance of the liquid in the container cannot wash the collected dirt back out into the main body of liquid from, or through, the element to any significant extent.

10 Claims, 1 Drawing Sheet

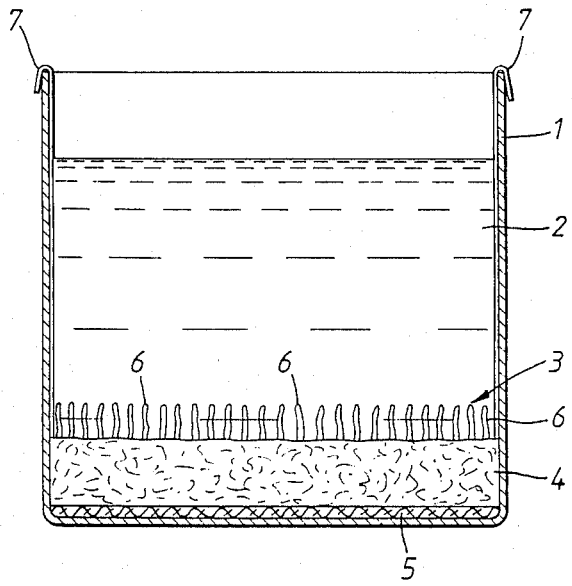
7
7
1
2
6
6
3
6
4
5

CLEANING EQUIPMENT

BACKGROUND OF THE INVENTION

1. Field of the Invention

The invention relates to cleaning equipment in which cleaning liquid is taken from a container, for example a bucket, and returned thereto after it has been used for dirt removal. It is of particular, but by no means exclusive, application to a cleaning bucket for use with a cleaning element or device, such as a floor mop, cleaning cloth or chamois leather which is repeatedly wrung out into the bucket.

2. Description of the Prior Art

A problem with the known cleaning equipment as aforesaid is that dirt deposited out from the cleaning liquid collects at the bottom of the container and that disturbance of the liquid, as when rinsing out a mop for example, washes the collected dirt back into the main body of liquid. In addition, a cleaning element such as a mop can pick up the collected dirt directly. Because of this the container is often emptied and cleaned out before the cleaning constituents of the liquid are actually exhausted.

In order to extend the life of a cleaning liquid, additives have been proposed which have the action of breaking the bond between the cleaning agent and the dirt, so that the dirt or "soil" as it is sometimes referred to in the cleaning industry is deposited out and falls to the bottom of the container. Whilst this theoretically keeps the liquid cleaner and extends the useful life thereof, the extra dirt deposited out increases the foregoing problem so that use of such additive is to some extent self defeating.

SUMMARY OF THE INVENTION

According to the invention cleaning equipment comprises a container provided with a dirt trap comprising a dirt-receiving element of mat or pad-like form which is positioned in the container to receive dirt settling under gravity from the contained liquid with the dirt collecting in, or passing through so as to be trapped below, the element, the form and structure of the element being such that disturbance of the liquid in the container cannot wash the collected dirt back out from or through the element to any significant extent.

Provided the two essential requirements are met, on the one hand that the deposited-out dirt can collect in or pass through the element and on the other hand that the deposited dirt cannot then be washed back into the main body of liquid as a result of disturbances in the latter, the mat or pad-like element can have any suitable threedimensional porous, cellular or mesh-like structure. The element may comprise a block or body of material formed or moulded with dirt-collecting passages. Such passages are preferably non-linear and, for example, a block of rubber or plastics material may be moulded with corkscrew-shaped passages.

However, preferably the element has a threedimensional fibrous mesh structure. It may comprise a mat or pad of superposed mesh layers or be a non-woven unitary mesh comprising a "jumble" of interlocking or bonded fibres, as for example in some plastics scouring pads manufactured for kitchen use or floor cleaning, and the mesh may have a more open structure at the top of the mat or pad and become progressively more dense towards the bottom. Thus the dirt can initially settle quickly into the element, then be collected selectively, according to particle size, throughout the depth of the mesh pad or mat element and more densely at the foot of the mat.

When the deposited dirt collects in the element itself it may be removable from the container therewith. In this case the element may be disposable with the dirt, or be reusable after the dirt has been washed out.

When the deposited dirt passes through the pad or mat element, the element may be positioned on a collector sheet or in a removable collector tray on or in which the dirt collects. Cleaning is then a simple matter of removing the tray, with the mesh element, and replacing them both after cleaning. Alternatively, the tray and mesh element may be a disposable assembly which is thrown away and replaced after use.

The top side of the mat may have an array of spaced fronds or strands which, in the manner of a seaweed such as kelp, will "float" and stand up when there is no (or very little) disturbance of the liquid, but will lie flat when disturbance is considerable thus sealing off the top of the mat or pad element to protect the latter, and the settled dirt, from the disturbance.

In addition to collecting passively the dirt deposited out from the cleaning liquid, the mat or pad element may be actively movable through the cleaning liquid to collect and remove suspended dirt particles therefrom. The dirt-receiving element may comprise a fibrous upper pad section which when the element is resting on the bottom of the container collects in a passive manner the larger dirt particles which deposit out under gravity, and a lower filter layer section which on replacement of the element (after removal and cleaning out) filters out and collects in an active manner smaller suspended particles in the liquid which did not previously settle out. The upper passive pad section and the active filter layer section may be combined as a unit, or may be separate members which when in position within the container rest one on top of the other. It is envisaged that in a typical cleaning case, such as floor mopping, of the order of 90% to 95% of the dirt will settle out and be collected passively by the upper pad, and that most of the residue could be collected actively by the lower filter layer as the cleaned-out element is replaced.

We have already mentioned the use of an additive to cause dirt to be deposited out from the cleaning liquid Although such an additive is efficient in its intended action it is costly and also has the disadvantage that the overall cleaning efficiency of the cleaning liquid is less than if the additive were not used. It is believed that by using an active dirt-collecting element in accordance with the invention, when the dirt is effectively "swept" out of the liquid, comparable results can be achieved (so far as dirt removal is concerned) without using the said additive. Thus the invention will provide increased cleaning efficiency at lower cost, with the advantages of dirt collection and removal.

The upper pad section and associated lower filter section may be assembled as a unit such that when placed on top of the liquid it sinks to the bottom of the container with the filter layer actively collecting the smaller dirt particles. When the two elements are separate and not joined as a unit, the lower filter element may be hydrodynamically shaped, for example being Frisbee-shaped or as a parachute, so that it will sink through the liquid in a stable manner.

The element material used may be manufactured in sheet or roll form from which it can be cut, for example in a press, into pieces of the required size and shape to fit the container with which it is intended to be used. Thus, for example, any existing or new design of cleaning bucket can be fitted with a pad of the material used.

The invention will be described hereinafter more specifically with regard to its application to a cleaning bucket which is a principal, but by no means exclusive, application for the invention. The dirt-receiving element may be fixed or "held" at the foot of the bucket by suction cups, hook and loop fasters of "Velcro" type, or other suitable readily detachable fixing means. If fitted into a tray or across a removable dirt sump in which the dirt collects after passing through the mesh, the assembly of tray (or dirt sump) and mat can be attached to "lifters" which enable the assembly to be lifted out, for cleaning, without the operative touching the cleaning liquid.

A mesh mat or pad element in accordance with the invention may be positioned to lie covering all of the bottom of the associated bucket, or so as to cover a specified low level part into which the dirt is forced to settle. It may extend across a collector region from which the dirt collected can be removed witout disturbing the pad or mat element or emptying out the bucket.

The fibrous mesh mat or pad may be shaped and constructed to seal to the bucket around the edges, or it may be designed to leave a gap at the bottom or it may even be allowed to float within the bucket on or in the cleaning liquid. It will readily be appreciated that the use of a dirt trap comprising a dirt-collecting mat or pad-like element in accordance with the invention lends itself to all types of cleaning operations, for example window cleaning, wall washing, vehicle cleaning, cleaning of articles generally (such as ash trays, for instance) and floor cleaning. It is also applicable to cleaning equipment such as floor cleaning machines.

Other features of the invention will be apparent from the following description, drawing and claims, the scope of the invention not being limited to the drawing itself as the drawing is presented solely for the purpose of illustrating a way in which the principles of the invention can be applied. Other embodiments of the invention which utilize the same or equivalent principles may be used and structural changes may be made as desired by those skilled in the art without departing from the present invention and the purview of the appended claims.

BRIEF DESCRIPTION OF THE DRAWING

The accompanying drawing diagrammatically illustrates, in vertical cross-section, a cleaning bucket provided with a dirt-receiving element in accordance with the invention.

DESCRIPTION OF THE PREFERRED EMBODIMENT

Referring to the accompanying drawing, a bucket 1 when in use contains a cleaning liquid 2 for use in a cleaning operation, for example a floor mopping operation. A dirt trap is provided by a dirt-receiving mat element 3 which rests on the bottom of the bucket 1 and covers the whole area thereof.

The element 3 is an assembly comprising a fibrous pad section 4, a lower filter layer section 5 and an upper two-dimensional surface array of closely spaced fronds such as 6 secured at their bottom ends to the pad section 4. The fibrous form of the pad section 4 provides a threedimensional mesh structure such that disturbances in the liquid 2 cannot wash back out into the body of liquid 2, to any material extent, dirt particles deposited from the liquid 2 and which settle into the inter-fibre spaces of the pad section 4. Suitable for the pad section 4 is a bonded random fibre material, for example a material consisting of bonded nylon/polyester staple fibres with a vinyl adhesive binder and a cross-linking melamine resin.

Thus, the pad section 4 collects the deposited dirt and then acts as an effective disturbance barrier against currents in the liquid washing the dirt back out from the element 3. As a further protection the fronds 6 have a buoyancy such that they "float" and extend upwardly in a generally upright fashion when there is no, or very little, disturbance of the liquid 2. However, when the disturbance is high, as when rinsing out a mop in the bucket 1, the fronds 6 lie down more or less flat against the top of the pad section 4 and thus cut off that section from the disturbance.

Larger dirt particles transferred by a mop, for example, to the cleaning liquid 2 settle out under gravity and collect in the upper pad member 4 of the element 3. After a reasonable amount of dirt has been collected the element 3 is removed by the operator and cleaned out, for example being hosed off in a sink. A suitable lifting tool (not shown) is provided, or alternatively lifting means such as opposite side handles 7 are attached to the element 3, so that the hands of the operator do not enter the liquid 2 when removing the element 3.

After it has been cleaned out the element 3 is replaced, being placed by the operator on top of the liquid 2. The element 3 then sinks under gravity through the body of the liquid 2 until it again rests on the bottom of the bucket 1 as shown in the drawing. As the element 3 sinks to the bottom of the bucket 1 it collects and filters out from the liquid 2 smaller particles which did not previously settle out in the pad section 4. Thus larger particles are collected in a passive manner by the pad section 4 and smaller particles which do not settle out on their own are collected in an active manner by the lower filter section 5.

While we have illustrated and described our invention in its preferred form, it will be apparent that the same is subject to alteration and modification without departing from the underlying principles involved, and we accordingly do not desire to be limited to the specific details illustrated and described except as may be necessitated by the appendant claims.

What is claimed is:

1. Cleaning equipment comprising a container for cleaning liquid, wherein the container is provided with a dirt trap comprising a dirt-receiving element of mat or pad-like form which is positioned in the container to receive dirt settling under gravity from the contained liquid with the dirt collecting in, or passing through so as to be trapped below, the element, the form and structure of the element being such that disturbance of the liquid in the container cannot wash the collected dirt back out from or through the element to any significant extent.

2. Cleaning equipment according to claim 1, wherein the container is a cleaning bucket suitable for use with a hand-held cleaning element or device.

3. Cleaning equipment according to claim 1, wherein the element has a three-dimensional fibrous mesh structure.

4. Cleaning equipment according to claim 3, wherein the element comprises a mat or pad of superposed mesh layers or is a non-woven unitary mesh comprising a "jumble" of interlocking or bonded fibres.

5. Cleaning equipment according to claim 4, wherein element consists of bonded nylon/polyester staple fibres with a vinyl adhesive binder and a cross-linking melamine resin.

6. Cleaning equipment according to claim 1, wherein the element comprises an upper dirt-receiving section adapted to receive deposited larger particles of dirt in a passive manner and has a structure such that the deposited dirt collects therein, and a lower filter layer section adapted to collect smaller particles of dirt in an active manner as the element is positioned in the container.

7. Cleaning equipment according to claim 1, wherein the element comprises an upper dirt-receiving section adapted to receive deposited larger particles of dirt in a passive manner and has a structure such that the deposited dirt collects therein, and a lower filter layer section adapted to collect smaller particles of dirt in an active manner as the element is positioned in the containerand said dirt-receiving section and the filter layer section of the element are assembled as a unit.

8. Cleaning equipment according to claim 7, wherein the element is a reusable unit which can be replaced in the container after removal therefrom and washing out of the collected dirt.

9. Cleaning equipment according to claim 1, wherein the top side of the element has an array of spaced fronds or strands which "float" and stand up when there is no (or very little) disturbance of the liquid, but which lie flat when disturbance is considerable thus act to seal off the top of the mat or pad element to protect the latter, and the settled dirt, from the disturbance.

10. For use in equipment according to claim 9, a dirtcollecting element for positioning at the bottom of the container of the equipment and which comprises a passive dirt-receiving section having a fibrous three-dimensional mesh structure, an active dirt-collecting lower filter layer section and, on the upper surface of the dirtreceiving section, an arrangement of distributed fronds or strands having a buoyancy such that they stand up in the cleaning liquid when undisturbed but tend to lie down on disturbance of the liquid.

* * * * *